US006656139B2

(12) United States Patent
Zwezdaryk

(10) Patent No.: US 6,656,139 B2
(45) Date of Patent: Dec. 2, 2003

(54) PERSONAL VIBRATOR

(76) Inventor: Shane Zwezdaryk, 46 Hyde Avenue, Apt. #2, Toronto (CA), M6M 1J4

( * ) Notice: Subject to any disclaimer, the term of this patent is extended or adjusted under 35 U.S.C. 154(b) by 0 days.

(21) Appl. No.: 09/874,246

(22) Filed: Jun. 6, 2001

(65) Prior Publication Data

US 2002/0188232 A1 Dec. 12, 2002

(51) Int. Cl.[7] ..... A61H 1/00
(52) U.S. Cl. ..... 601/46; 601/70; 600/38
(58) Field of Search ..... 601/46, 70, 48, 601/72, 74, 73, 80; 600/38

(56) References Cited

U.S. PATENT DOCUMENTS 3,900,023 A 8/1975 McBride ..... 128/36
4,091,805 A * 5/1978 Clark ..... 601/136
4,574,788 A * 3/1986 Jordan ..... 601/137
5,067,480 A * 11/1991 Woog et al. ..... 601/46
5,573,499 A 11/1996 McAllister ..... 601/70
5,611,771 A * 3/1997 Taylor ..... 601/70
5,772,614 A * 6/1998 Lindquist ..... 601/116
5,904,661 A * 5/1999 Bonz et al. ..... 601/137
6,450,980 B1 * 9/2002 Robbins et al. ..... 601/137

* cited by examiner

*Primary Examiner*—Nicholas D. Lucchesi
*Assistant Examiner*—Tam Nguyen
(74) *Attorney, Agent, or Firm*—Gowling Lafleur Henderson LLP

(57) ABSTRACT

A vibrator is provided that has a base member and elongated flexible elements extending from the base member for contacting a user. A vibrator includes vibration means that is mounted within the vibrator of causing the vibrator to vibrate. The elongated flexible elements are positionable by a user in a plurality of configurations, as desired.

10 Claims, 6 Drawing Sheets

PERSONAL VIBRATOR

FIELD OF THE INVENTION

The present invention relates to vibrators, and more particularly to a personal vibrator that is positionable by a user in varying configurations.

BACKGROUND OF THE INVENTION

For many years devices for sexually stimulating a user, commonly referred to as vibrators, stimulators and exciter devices, have been used for a variety of reasons. These devices can be used for pleasure by couples, groups or by individuals seeking sexual stimulation. These devices may also be employed as a sexual aid or a therapy device when a sexual partner is unable to sexually perform or fulfill a partners sexual need.

One type of device, usually referred to as a vibrator, is generally manufactured with a vibrating mechanism located within the device. Many vibrators are phallus shaped and are manufactured in varying lengths and widths to suit an individuals preference. However, a user cannot generally change the dimensions of the vibrator and will have to purchase several devices in order to achieve any variance in the degree of penetration that may be desired. These devices are generally manufactured for use by either a male or a female and not adaptable to be used by both.

It is therefore desirable to provide a vibrator that can be manipulated by a user in order to achieve the required stimulation that is desired.

SUMMARY OF THE INVENTION

A vibrator is provided that has a base member and a plurality of elongated flexible elements extending from the base member for contacting a user. The vibrator also has vibration means that is mounted within the vibrator for causing the vibrator to vibrate. The elongated flexible elements are positionable by the user in a plurality of configurations.

BRIEF DESCRIPTION OF THE DRAWINGS

The invention will be better understood with reference to the drawings and following description in which.

DETAILED DESCRIPTION OF THE INVENTION

Figure 1:
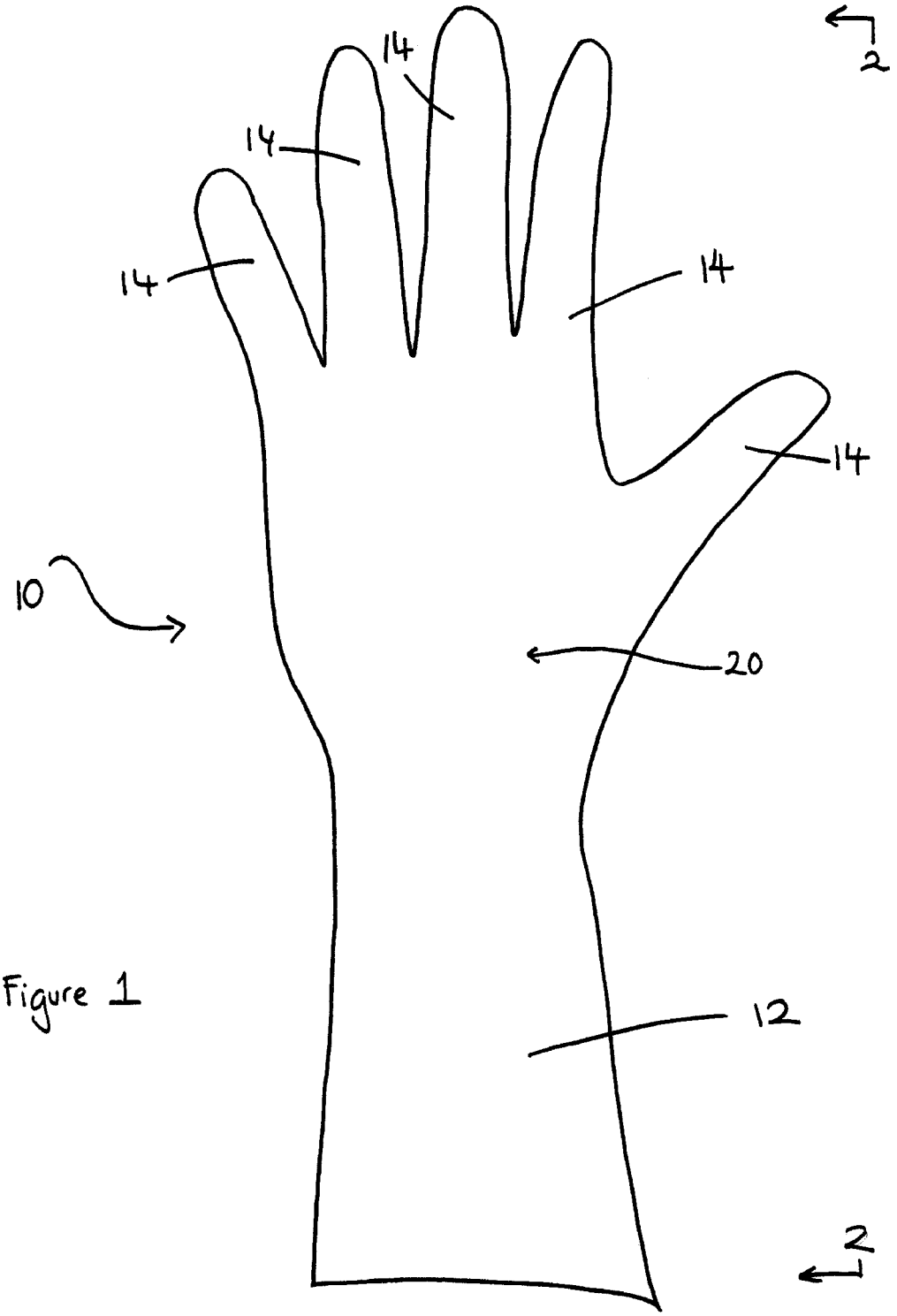
FIG. 1 is a perspective view of a preferred embodiment of a personal vibrator having a base member and a plurality of elongated flexible elements in the shape of a hand according to the present invention.
Figure 2:
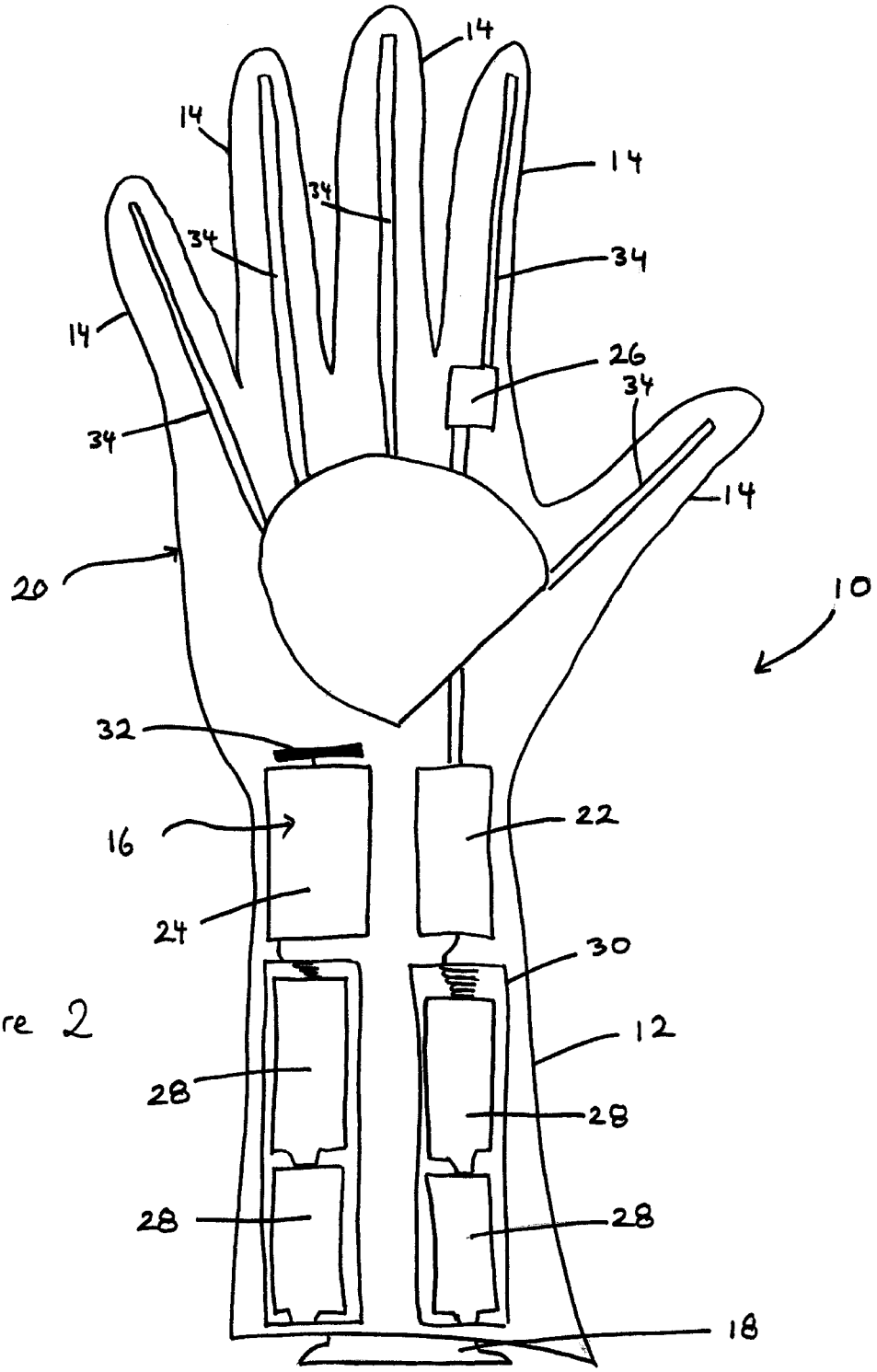
FIG. 2 is a sectional view along line 2—2 of the personal vibrator of FIG. 1

Referring now to FIGS. 1 and 2 a preferred embodiment of the present invention is indicated generally at 10. The vibrator 10 has a base member 12 and a plurality of elongated flexible elements 14 extending from the base member 12 for contacting a user. Mounted in the vibrator 10 is vibration means 16 for causing the vibrator 10 to vibrate. The elements 14 are positionable by the user in a plurality of configurations, shown in FIGS. 3–8.

The vibrator 10 is preferably hand-shaped with the base member 12 representing the wrist and palm features of a hand, and the elements 14 representing the fingers of a hand. The vibrator 10 can be hand-held by a user or alternatively, the vibrator 10 can be mounted on a surface, not shown, using mounting means 18. The mounting means 18 is preferably a suction cup.

In order to provide a life-like feel to the vibrator 10, a cover 20 is attached to the exterior surface of the base member 12 and the elements 14. The cover 20 is flexible and strong in order to accommodate the movement of the elements 14 into the desired configurations required by a user. Preferably, the cover 20 is made of latex.

As mentioned previously, the base member 12 is preferably shaped like a wrist and a palm of a human hand. Base member 12 is hollow and contains a first motor 22, a second motor 24 and an actuator 26, mounted between the first motor 22 and at least one of the elements 14. The first motor 22 is configured to receive power from a power source, represented in the presently preferred embodiment by batteries 28. The batteries 28 maybe stored in a compartment 30 located in the base member 12. The first motor 22 is configured to receive power from the batteries 28 and to drive the actuator 26, which in turn is configured to cause at least one of the elements 14 to oscillate.

In the preferred embodiment, the first motor 22 is configured to drive the actuator 26 which in turn oscillates one of the elements 14, however, the actuator 26 can also be configured to drive more than one of the elements 14.

The second motor 24 is mounted within the base member 12 and attached to an unbalanced mass 32. The second motor 24 is configured to receive power from a power source, preferably batteries 28. The unbalanced mass 32 is attached to the second motor 24 in order to impart vibratory motion on the vibrator 10 when the second motor 24 rotates in response to receiving power from the batteries 28.

The elements 14 are elongated and flexible, to allow a user to configure the elements 14 into a desired position, examples of some positions are shown in FIGS. 3–8. The elements 14 are made to replicate the fingers on a human hand and preferably are in similar proportion to a hand. However, varying lengths of fingers may also be manufactured. Each of the elements 14 contains an elongated flexible strip 34, preferably made from a flexible metal material.

Figure 3:
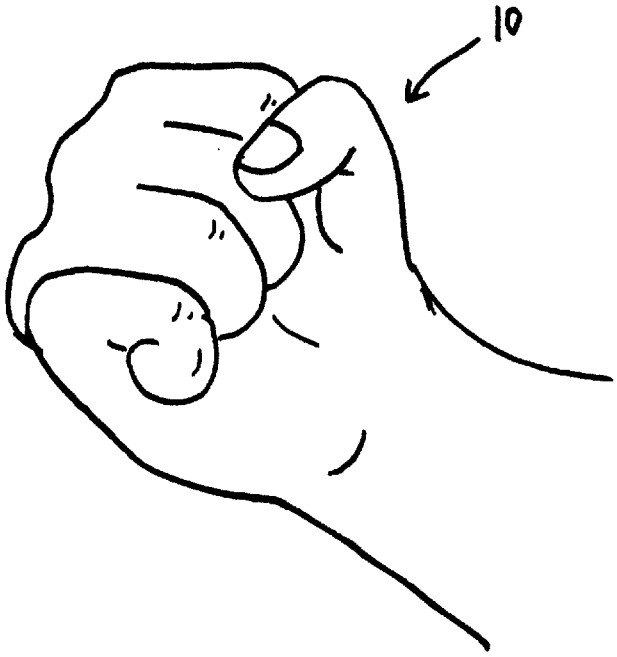
FIG. 3 is a perspective view of the personal vibrator of FIG. 1 with the elements positioned in a fist shape.
Figure 4:
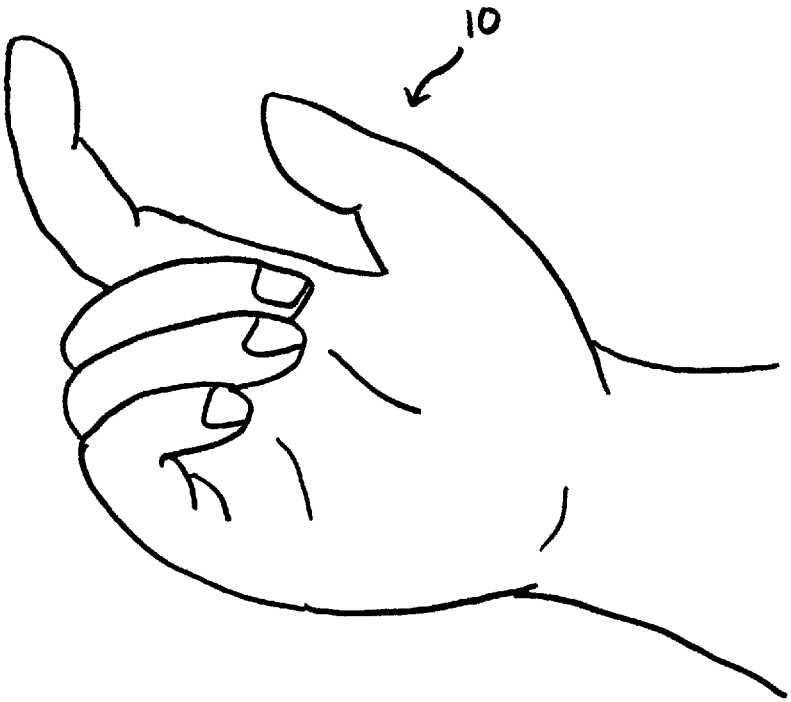
FIG. 4 is a perspective view of the personal vibrator of FIG. 1 with the elements positioned in one of a plurality of configurations with one element extended.
Figure 5:
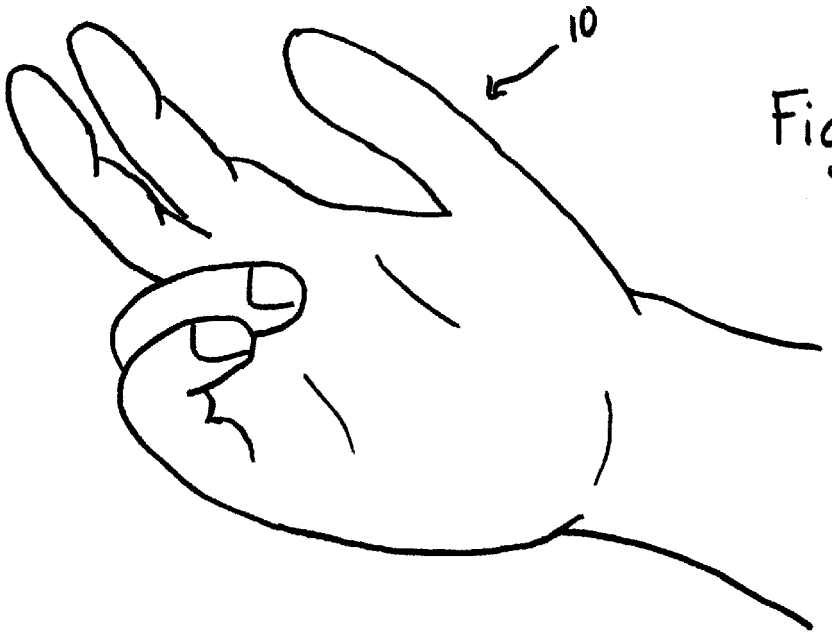
FIG. 5 is a perspective view of the personal vibrator of FIG. 1 with the elements positioned in one of a plurality of configurations with two elements extended.
Figure 6:
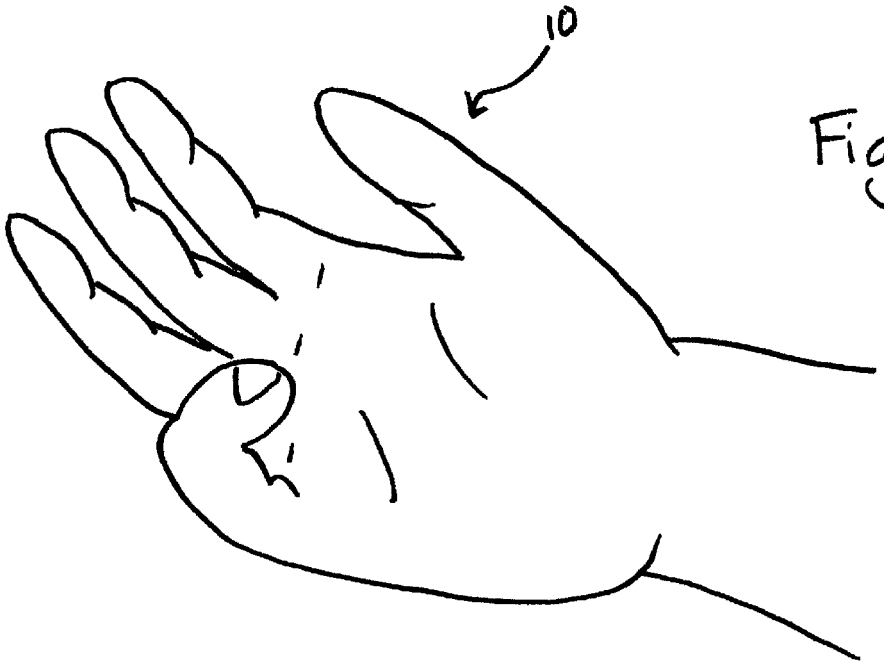
FIG. 6 is a perspective view of the personal vibrator of FIG. 1 with the elements positioned in one of a plurality of configurations with three elements extended.
Figure 7:
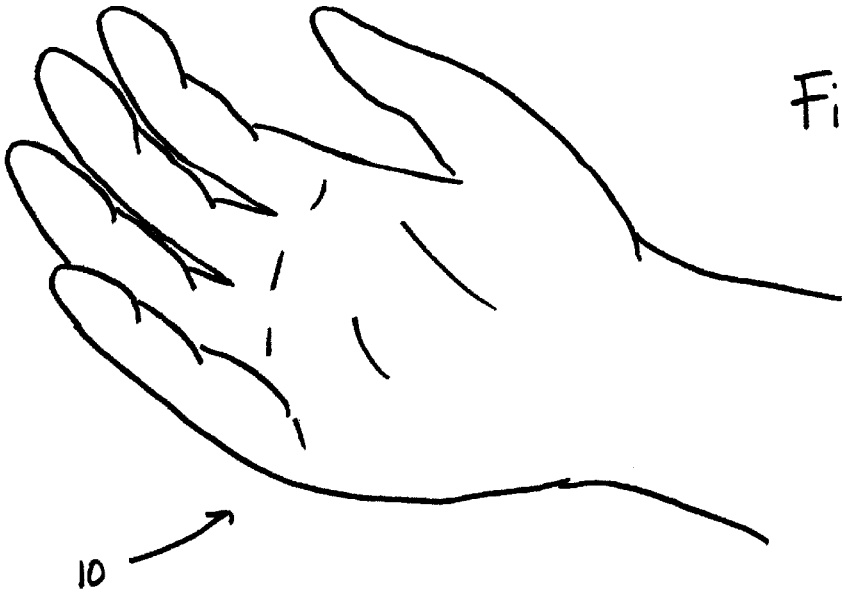
FIG. 7 is a perspective view of the personal vibrator of FIG. 1 with the elements positioned in one of a plurality of configurations with all the elements extended.
Figure 8:
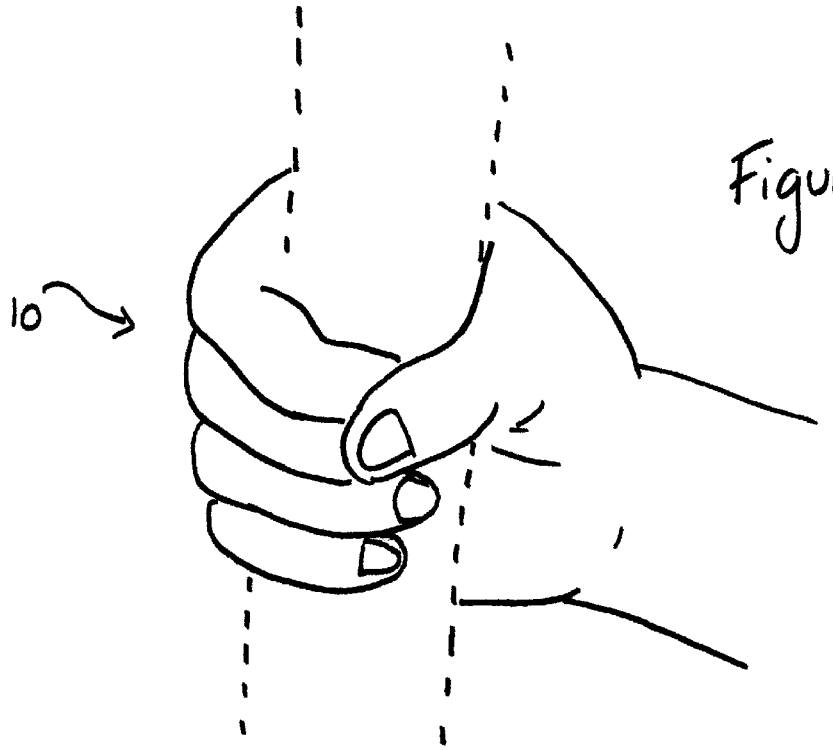
FIG. 8 is a perspective view of the personal vibrator of FIG. 1 with the elements positioned in a grip like position configured to hold a shaft shown in ghost outline.

The flexible strips 34 allow a user to manipulate and maintain the elements 14 in a desired position. As shown in FIGS. 3–8, several different positions can be achieved when a user manipulates the elements 14. Examples of some of the positions include a fist as shown in FIG. 3, a hand with one to four fingers extended as shown in FIGS. 4–7, and a hand in a grip-like position that can receive a shaft as shown in FIG. 8.

The use of the vibrator 10 will now be described with reference to FIGS. 1–8. In order for a user to employ the use of the vibrator 10, a power source must be obtained. In the presently preferred embodiment, the power source is the batteries 28. The batteries 28 are located in the compartment 30 in the base member 12. After the batteries 28 have been installed in the vibrator 10, the user can manipulate the elements 14 into the desired position. As previously discussed, these positions can vary as shown in FIGS. 3–8.

In order to start the vibrating motion in the vibrator 10, a user must turn the power on using an on/off switch (not shown). Power is received by the second motor 24, which turns the unbalanced mass 32 and causes a vibratory motion to be imparted on the vibrator 10. To initiate an oscillating motion in at least one of the elements 14, the power is also received by the first motor 22 which drives the actuator 26 which in turn causes the elements 14, to which the actuator 26 is attached, to oscillate. The vibrator 10 is then ready to be used, as desired, by the user. It should be noted that it is not necessary for the user to initiate the vibrations and oscillations prior to use, both can be switched on once the vibrator 10 is in the desired position.

While the embodiment is discussed herein is directed to a particular implementation of the invention, there will be apparent that variations of this embodiment are within the scope of the invention. For example, the vibrator can be shaped to represent other objects that have a series of elements extending therefrom. The strips located inside the elements can be made of any suitable material that is strong and flexible. The cover can be made from any material that is strong, flexible and will not cause irritation upon contact with a user.

Figure 9:
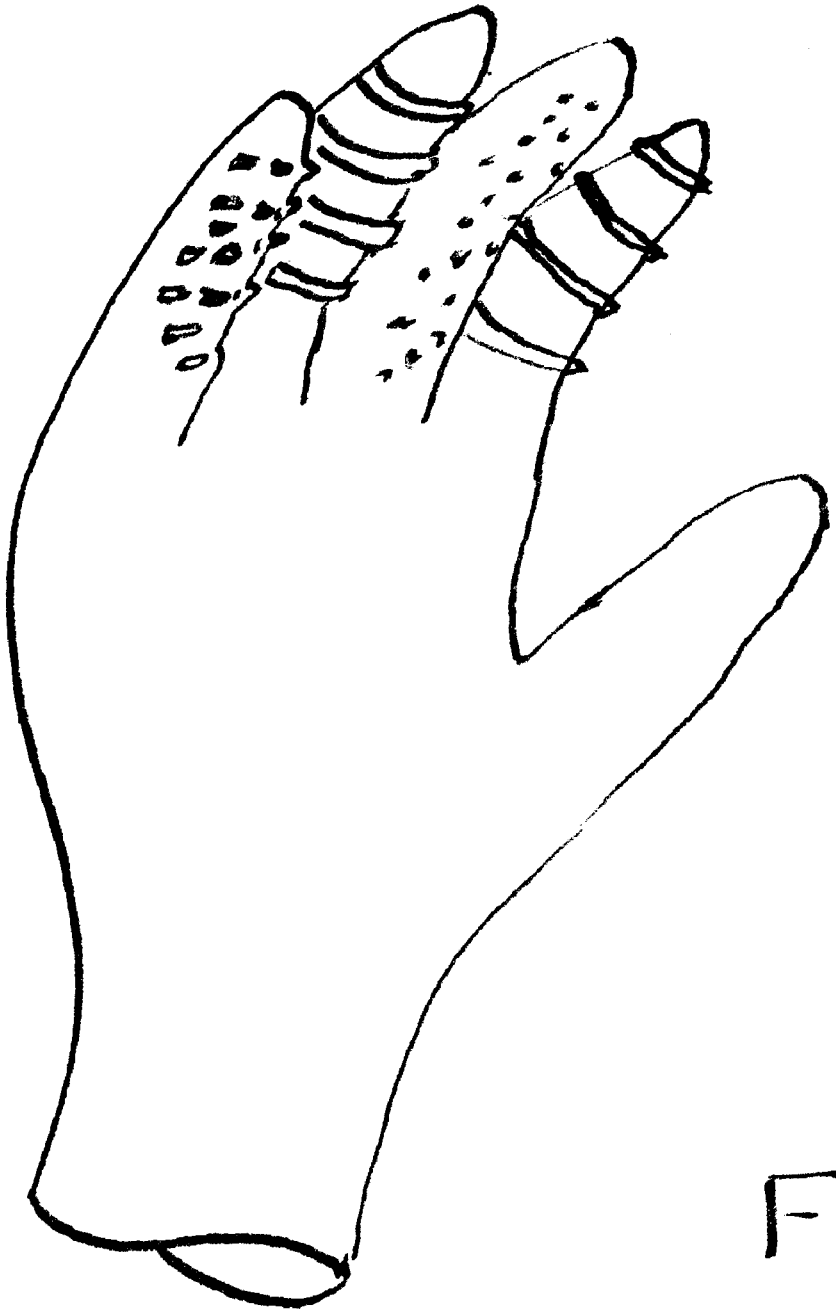
FIG. 9 is a perspective view of cover for the personal vibrator of FIG. 1.

In order to produce enhanced stimulation, the cover 20 of the vibrator 10 may be further provided with a textured rather than a smooth outer surface. Alternatively, a glove shaper-outer cover, such as illustrated by reference 50 in FIG. 9 might be provided. The outer cover 50 may have ridges 52 or bumps 54 as texturing to provide enhanced sensation. The outer cover 50 would be removably installed over the cover 20 and need not be glove shaped, for example individual finger shaped covers might be used.

The above described embodiments of the invention are intended to be examples of the present invention and alterations and modifications may be effected thereto, by those of skill in the art, without departing from the scope of the invention which is defined solely by the claims appended hereto.

I claim:

1. A hand-shaped vibrator comprising:

a base member;

a plurality of elongated finger-shaped flexible elements extending from the base member for contacting a user, said elements being positionable individually by the user in a plurality of configurations;

vibration inducing means mounted within the vibrator for causing the vibrator to vibrate; and, element oscillating means for driving an actuator mounted between said oscillating means and at least one of said elements to cause said element to oscillate.

2. The vibrator of claim 1, wherein the element oscillating means comprises a first motor for driving the actuator.

3. The vibrator of claim 1, wherein the vibrator further comprises a cover coupled to the exterior surface of the base member and the plurality of elements.

4. The vibrator of claim 3, wherein the cover is latex.

5. The vibrator of claim 2, wherein the vibration inducing means comprises a second motor and an unbalanced mass coupled to the second motor for imparting a vibratory motion on the vibrator.

6. The vibrator of claim 1, wherein the base member comprises mounting means for attaching the vibrator to a surface.

7. The vibrator of claim 6, wherein the mounting means is a suction cup.

8. The vibrator of claim 2, wherein the first motor is powered by batteries and the base member has at least one compartment for storing the batteries.

9. The vibrator of claim 5, wherein the second motor is powered by batteries and the base member has at least one compartment for storing the batteries.

10. The vibrator of claim 3 further having a textured outer cover for mounting over said cover.

* * * * *